US007204303B2

(12) United States Patent
Thomas et al.

(10) Patent No.: US 7,204,303 B2
(45) Date of Patent: Apr. 17, 2007

(54) FLAT TUBE COLD PLATE ASSEMBLY

(75) Inventors: Andy Thomas, Chelmsford, MA (US); Boris Akselband, Brighton, MA (US); Brian Rollins, Costa Mesa, CA (US)

(73) Assignee: Lytron, Inc., Woburn, MA (US)

( * ) Notice: Subject to any disclaimer, the term of this patent is extended or adjusted under 35 U.S.C. 154(b) by 0 days.

(21) Appl. No.: 11/015,625

(22) Filed: Dec. 17, 2004

(65) Prior Publication Data

US 2005/0145379 A1 Jul. 7, 2005

Related U.S. Application Data

(60) Provisional application No. 60/530,442, filed on Dec. 17, 2003.

(51) Int. Cl.
*F28F 3/12* (2006.01)

(52) U.S. Cl. ..... 165/170; 165/80.4; 165/185

(58) Field of Classification Search ..... 165/170, 165/185, 80.4, 80.5; 29/890.03, 890.035, 29/890.036

See application file for complete search history.

(56) References Cited

U.S. PATENT DOCUMENTS 2,957,679 A * 10/1960 Campbell ..... 165/148
5,567,493 A * 10/1996 Imai et al. ..... 428/36.9
5,898,995 A * 5/1999 Ghodbane ..... 29/890.03
6,377,457 B1 * 4/2002 Seshan et al. ..... 165/185
6,462,949 B1 * 10/2002 Parish et al. ..... 165/80.4
6,563,709 B2 * 5/2003 Negishi et al. ..... 165/80.4
2003/0161104 A1 * 8/2003 Hartzell et al. ..... 361/699
2004/0069474 A1 * 4/2004 Wu et al. ..... 165/170
2005/0115700 A1 * 6/2005 Martin et al. ..... 165/170

* cited by examiner

*Primary Examiner*—Teresa J. Walberg
(74) *Attorney, Agent, or Firm*—Weingarten, Schurgin, Gagnebin & Lebovici LLP

(57) ABSTRACT

A flat tube cold plate assembly has a channel plate having an opening therethrough defining a flow path. A plurality of flat tubes is retained within the opening in the channel plate along the flow path. A plurality of fins extends within the interior of the flat tube. An upper cover plate and a lower cover plate are fixed over the channel plate with the flat tube disposed therein, for example, by brazing. The flat tube may be readily formed by an extrusion process. The opening in the channel plate may be readily formed by a process such as laser cutting, stamping, or etching.

21 Claims, 3 Drawing Sheets

FLAT TUBE COLD PLATE ASSEMBLY

CROSS REFERENCE TO RELATED APPLICATIONS

This application claims the benefit under 35 U.S.C. §119(e) of U.S. Provisional Application No. 60/530,442, filed Dec. 17, 2003, the disclosure of which is incorporated by reference herein.

STATEMENT REGARDING FEDERALLY SPONSORED RESEARCH OR DEVELOPMENT

N/A

BACKGROUND OF THE INVENTION

Electronic components mounted on circuit boards generate heat that must be dissipated to assure proper functioning of the components. Air is typically used to cool the circuit board when the total power dissipated is low or when the power density is low. In high power applications, liquid can be used to provide significantly improved cooling, but at an added level of complexity. The liquid must be contained so it does not contact the components directly.

A way to contain cooling liquid is to use a liquid-cooled cold plate, typically made of copper, aluminum, or alloys thereof. The cold plate has channels within it that distribute the cooling liquid and has inlets and outlets that enable the liquid to enter and exit the cold plate. The cold plate is mated to the electronic circuit board that requires cooling. Electrical components on the circuit board are cooled by contact with the cold plate such that heat is transferred from the components to the cooling fluid.

In a typical manufacturing technique for creating high performance vacuum-brazed cold plates, a channel is machined in a metal plate, typically a ½ inch to 1½ inch thick aluminum plate. The channel is filled with a plurality of fins formed in a custom stamping operation to provide a large surface area for the heat transfer function. A cover plate is added to the top, and the whole assembly is vacuum-brazed together. Fluid inlet and outlet fittings are attached at suitable locations, such as along the edge of the cold plate, to deliver fluid into and out of the channel.

SUMMARY OF THE INVENTION

The present invention relates to a cold plate assembly that achieves high heat transfer performance at lower cost. A plurality of flat tubes is arranged along a fluid flow path defined by an opening(s) in a channel plate. The flat tubes and the channel plate form a substantially planar structure that is sandwiched between upper and lower cover plates.

The flat tubes have upper and lower surfaces joined by side walls defining an interior space extending in an elongated direction from a first open end to a second open end. A plurality of fins extend within the interior space in the elongated direction from the first open end to the second open end. The flat tubes are disposed in the opening in the channel plate along portions of the fluid flow path. The opening in the channel plate includes regions adjacent the ends of the flat tubes to direct fluid on the flow path from an inlet through the flat tubes to an outlet.

The present invention also relates to a method of forming the flat tube cold plate assembly. The opening in the channel plate can be formed by, for example, laser cutting, stamping, or etching. The flat tubes can be readily formed by an extrusion process. The channel plate and the flat tubes are sandwiched between the upper and lower cover plates, and the entire assembly is fastened by, for example, vacuum brazing. This method avoids the channel machining step and the custom fin stamping step of the prior art.

DESCRIPTION OF THE DRAWINGS

The invention will be more fully understood by reference to the following detailed description when considered in conjunction with the accompanying drawings, in which.

DETAILED DESCRIPTION OF THE INVENTION

Figure 1:
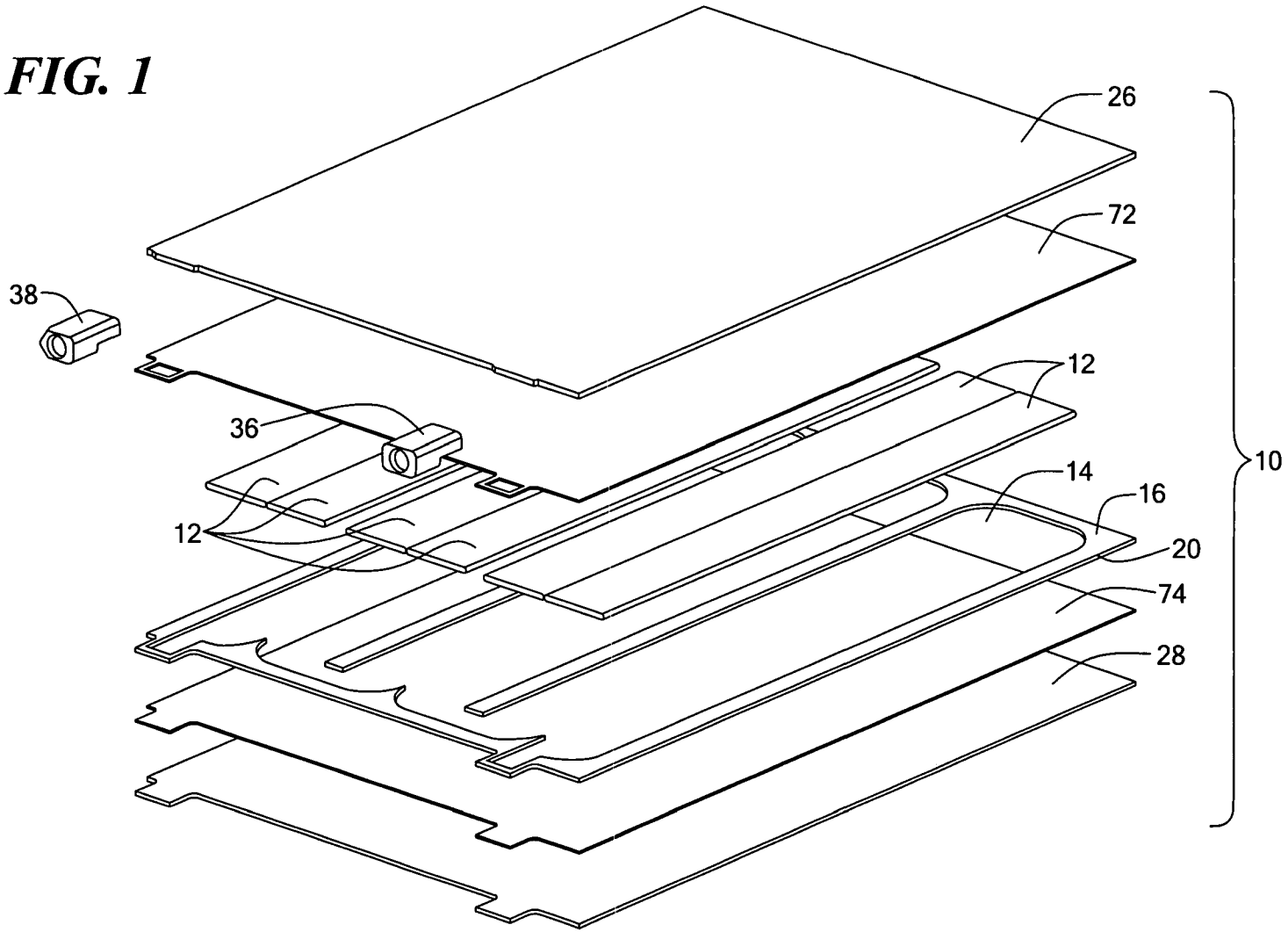
FIG. 1 is an exploded isometric view of a cold plate assembly according to the present invention.
Figure 2:
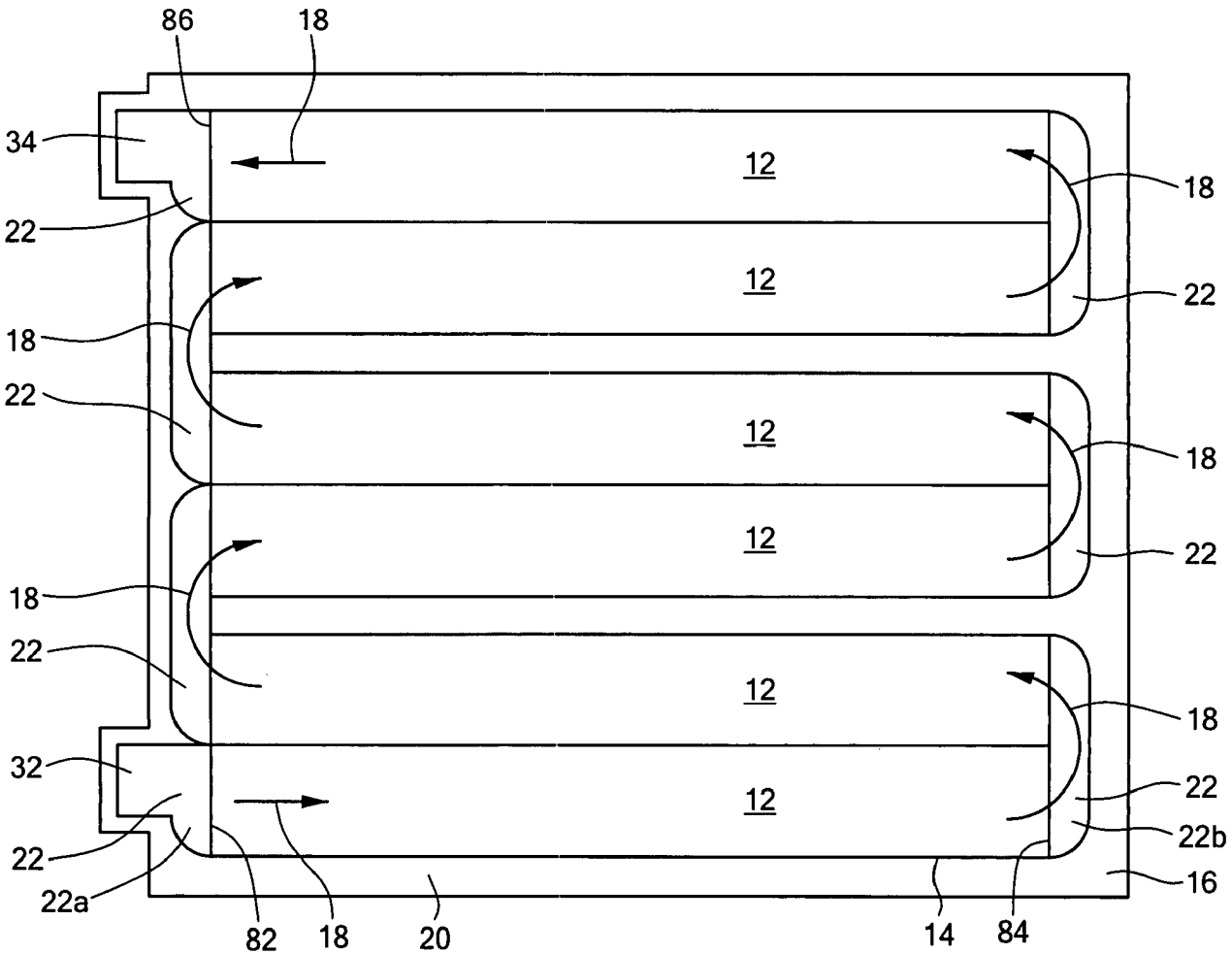
FIG. 2 is a plan view of the channel plate and flat tubes of the cold plate of FIG. 1 illustrating a fluid flow path therethrough.
Figure 3:
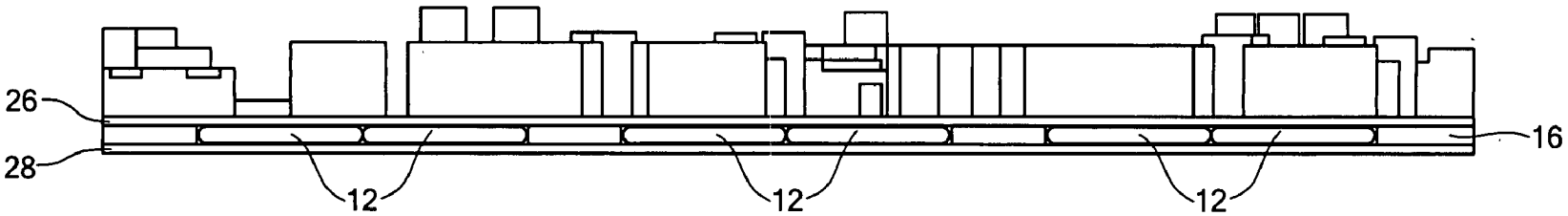
FIG. 3 is a cross-sectional view of the cold plate assembly further illustrating an associated circuit board.

An embodiment of a flat tube cold plate assembly 10 according to the present invention is illustrated in FIGS. 1–3. A plurality of flat tubes 12 is disposed in an opening(s) 14 in a channel plate 16. The tubes include internal fins, described further below, to aid in the heat transfer. The opening in the channel plate defines a fluid flow path therethrough (indicated by arrows 18 in FIG. 2) for a cooling fluid, and the channel plate provides a frame 20 for retaining the flat tubes on the flow path. The opening in the channel plate also includes regions 22 located at the ends of the flat tubes through which the cooling fluid is directed into and out of the flat tubes. An upper cover plate 26 and a lower cover plate 28 are provided over the flat tubes and the channel plate to retain all the components in an assembly and to seal the flow path. A fluid inlet 32 and a fluid outlet 34 are provided via one or more fittings 36, 38 attached at suitable locations, such as along the edge of the cold plate, to deliver fluid into and out of the flow path. The cooling fluid may be water or another suitable fluid. Suitable materials for the flat tubes, the channel plate, and the cover plates include aluminum, copper, and alloys of aluminum and copper, although other thermally transmissive materials can be used. The opening may be formed in the channel plate in any suitable manner, such as by laser cutting, stamping, or etching.

Figure 4:
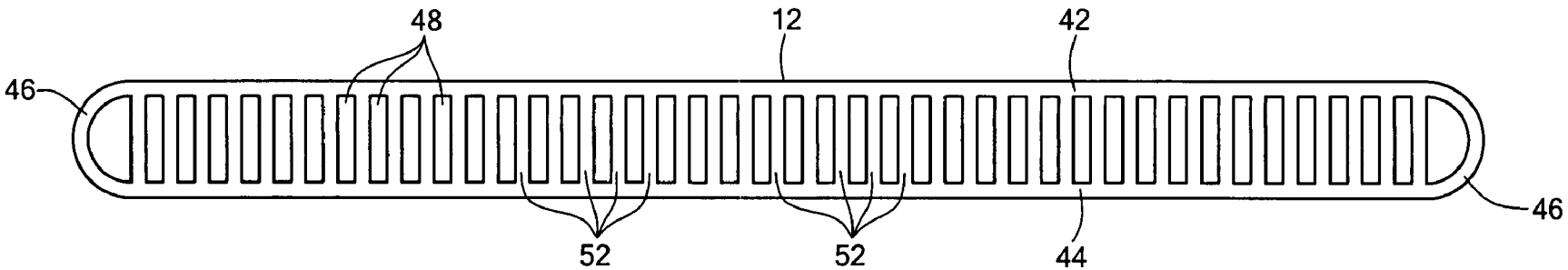
FIG. 4 is an end view of a flat tube of the cold plate assembly.

Referring more particularly to FIG. 4, each tube 12 has a flat, elongated upper wall 42 and a flat, elongated lower wall 44. The upper and lower walls are joined along their longitudinal edges by short, generally curved, side walls 46. The inner surfaces of the upper wall, lower wall, and side walls form a fluid passageway 48 through the tube. The tube is open on each end so that cooling fluid flows into one end and out the other end. A plurality of internal fins 52 extends the length of the flat tube. The elongated fins aid in heat transfer to the cooling fluid as it flows along the tube.

The tubes with the internal fins can be readily formed by an extrusion process. The tubes can be extruded in the flat configuration, as illustrated in FIG. 4, and cut to appropriate lengths. Alternatively, the tubes can be extruded in a circular cross section with inwardly directed teeth. Using suitable tooling, the tubes can then be formed or flattened into the flat tube shape with pairs of the teeth coming in contact to form the fins.

The cover plates 26, 28, the flat tubes 12, and the channel plate 16 may be fixed or fastened together in any suitable manner, such as by vacuum brazing. The flat tubes and the channel plate preferably form a substantially planar structure having a substantially uniform thickness, so that when assembled they provide substantially planar upper and lower surfaces. In this manner, the cover plates can be readily brazed or otherwise attached to the upper and lower surfaces of the flat tubes and the channel plate to provide an integral, sealed structure. In the embodiment illustrated in FIG. 1, a braze sheet 72 is provided between the upper cover plate 26 and the upper surface of the flat tubes and the channel plate, and a further braze sheet 74 is provided between the lower cover plate 28 and the lower surface of the flat tubes and the channel plate, and the entire assembly is brazed. Alternatively, the braze sheet and cover plate can be combined as a single clad braze sheet. The fittings 36, 38 are then attached in any suitable manner, such as by soldering, brazing, welding, or gluing. The fittings can alternatively be attached during the brazing of the flat tubes, the channel plates, and the cover plates.

In the embodiment illustrated, a serpentine flow path is provided, as indicated by the arrows 18 in FIG. 2. Cooling fluid, such as water, enters into the cold plate assembly at the inlet 32 and flows into the first region 22*a* in the channel plate at the entrance end 82 of the first flat tube 12. The fluid then flows through the flat tube to the other end 84. Upon exiting the flat tube, the fluid flows through another region 22*b* in the channel plate that extends the width of the ends of two adjacent tubes and defines a curved portion of the flow path. The fluid flows through this region into the second flat tube. In a similar manner, the fluid flows in turn through each of the remaining flat tubes and connecting regions in the channel plate. The fluid reaches the outlet 34 at the end 86 of the last flat tube 12, from which the fluid exits the cold plate assembly. The flat tubes may be provided in any number and arranged in any configuration to achieve the desired heat transfer performance.

The flat tubes and the channel plate can be manufactured with any suitable thickness depending on the particular application. The thickness of the flat tubes and the channel plate can be on the order of 0.1 inch. In one exemplary embodiment, the flat tubes and the channel plate are 0.13 inch thick.

The flat tube cold plate assembly of the present invention is advantageous in that it avoids the channel machining step and the custom fin stamping step of the prior art. In this manner, the present cold plate assembly achieves a high performance cold plate at lower cost.

The invention is not to be limited by what has been particularly shown and described, except as indicated by the appended claims.

What is claimed is:

1. A flat tube cold plate assembly comprising;

a channel plate comprising a plate having upper and lower surfaces and a thickness, an opening formed through the thickness of the channel plate, the opening defining a fluid flow path in the plane of the channel plate;

a flat tube having upper and lower surfaces joined by side walls defining an interior space extending in an elongated direction from a first open end to a second open end, and a plurality of fins within the interior space extending in the elongated direction from the first open end to the second open end;

the flat tube disposed in at least part of the opening in the channel plate along a portion of the fluid flow path, the channel plate forming a frame around the flat tube, the upper and lower surfaces of the flat tube and the upper and lower surfaces of the channel plate respectively substantially planar;

the opening through the channel plate including regions adjacent the first end of the flat tube and the second end of the flat tube along a further part of the fluid flow path, the regions defining a portion of the fluid flow path directed into and out of the flat tube;

an upper cover plate and a lower cover plate disposed over the channel plate with the flat tube disposed therein and covering the regions adjacent the first and second ends of the flat tube; and an inlet and an outlet to the fluid flow path located at associated ones of the regions in the channel plate.

2. The assembly of claim 1, wherein the flat tube is formed of a thermally transmissive material.

3. The assembly of claim 1, wherein the flat tube comprises aluminum, copper, or an alloy of aluminum or copper.

4. The assembly of claim 1, wherein the flat tube comprises an extrusion.

5. The assembly of claim 1, wherein the channel plate is formed of a thermally transmissive material.

6. The assembly of claim 1, wherein the channel plate comprises aluminum, copper, or an alloy of aluminum or copper.

7. The assembly of claim 1, wherein the upper cover plate and the lower cover plate are brazed to the flat tube and the channel plate.

8. The assembly of claim 1, further comprising at least one additional flat tube disposed within a further part of the opening of the channel plate along a further portion of the fluid flow path, the side walls of the additional flat tube adjacent edges of the opening, the opening in the channel plate further including additional regions adjacent ends of the additional flat tube.

9. The assembly of claim 1, further comprising a cooling fluid within the fluid flow path.

10. The assembly of claim 9, wherein the cooling fluid comprises water.

11. A method of forming a cold plate assembly comprising:

providing a channel plate of a thermally transmissive material and having a thickness;

forming an opening through the thickness of the channel plate, the opening configured to form a fluid flow path in the plane of the plate;

providing a flat tube of a thermally transmissive material, the flat tube having substantially parallel upper and lower surfaces joined by side walls defining an interior space extending in an elongated direction from a first open end to a second open end, and a plurality of fins within the interior space extending in the elongated direction from the first open end to the second open end;

assembling the flat tube in the opening in the channel plate along a portion of the flow path therethrough, the channel plate forming a frame around the flat tube, the flat tube and the channel plate forming a substantially planar structure, the fluid flow path including regions adjacent the first open end and the second open end of the flat tube to direct flow into and out of the flat tube; and fixing an upper cover plate and a lower cover plate over the flat tube and the regions adjacent the first and second open ends of the flat tube in the channel plate.

12. The method of claim 11, wherein in the step of providing the flat tube, the flat tube is extruded.

13. The method of claim 11, wherein in the step of providing the flat tube, the flat tube is extruded in a flattened shape.

14. The method of claim 11, wherein in the step of forming an opening through the channel plate, the opening is laser cut.

15. The method of claim 11, wherein in the step of forming an opening through the channel plate, the opening is stamped.

16. The method of claim 11, wherein in the step of forming an opening through the channel plate, the opening is etched.

17. The method of claim 11, wherein the upper and lower cover plates are brazed to the flat tube and the channel plate.

18. The method of claim 11, wherein the upper and lower cover plates are brazed to the flat tube and the channel plate with a braze sheet adjacent the upper cover plate and the lower cover plate.

19. The method of claim 11, wherein the upper and lower cover plates comprise clad braze sheets.

20. The method of claim 11, further comprising providing a plurality of flat tubes in openings in the channel plate, the flat tubes and openings in the channel plate defining a fluid flow path therethrough.

21. The method of claim 11, further comprising providing an inlet and an outlet to allow a cooling fluid to flow into the flat tube within the channel plate.

* * * * *